US005253500A

United States Patent [19]

Willoughby

[11] Patent Number: 5,253,500

[45] Date of Patent: Oct. 19, 1993

[54] METHOD OF REFORMING A METAL CONTAINER TO INCREASE CONTAINER STRENGTH

[75] Inventor: Otis H. Willoughby, Boulder, Colo.

[73] Assignee: Ball Corporation, Muncie, Ind.

[21] Appl. No.: 845,089

[22] Filed: Mar. 3, 1992

[51] Int. Cl.[5] ..... B21D 51/26

[52] U.S. Cl. ..... 72/84; 72/379.4

[58] Field of Search ..... 72/82, 84, 111, 379.4

[56] References Cited

U.S. PATENT DOCUMENTS 4,885,924 12/1989 Clayton et al. ..... 72/111

4,989,434 2/1991 Brossia et al. ..... 72/82

FOREIGN PATENT DOCUMENTS 16580 6/1970 Japan ..... 72/84

*Primary Examiner*—Lowell A. Larson

*Attorney, Agent, or Firm*—Gilbert E. Alberding

[57] ABSTRACT

A method of enhancing the axial strength of a metal container includes reforming the lower sidewall portion of a container which has a stripper bulge integrally formed therein as a result of conventional stripping operations by rotating the container, moving a bearing element axially toward the closed end of the container to engage the stripper bulge and continue moving the bearing element axially for a predetermined distance along a linear path disposed at an acute angle in relation to the central axis of the container to thereby deflect the stripper bulge and the lower sidewall portion of the container radially inwardly and substantially reduce the stripper bulge.

25 Claims, 2 Drawing Sheets

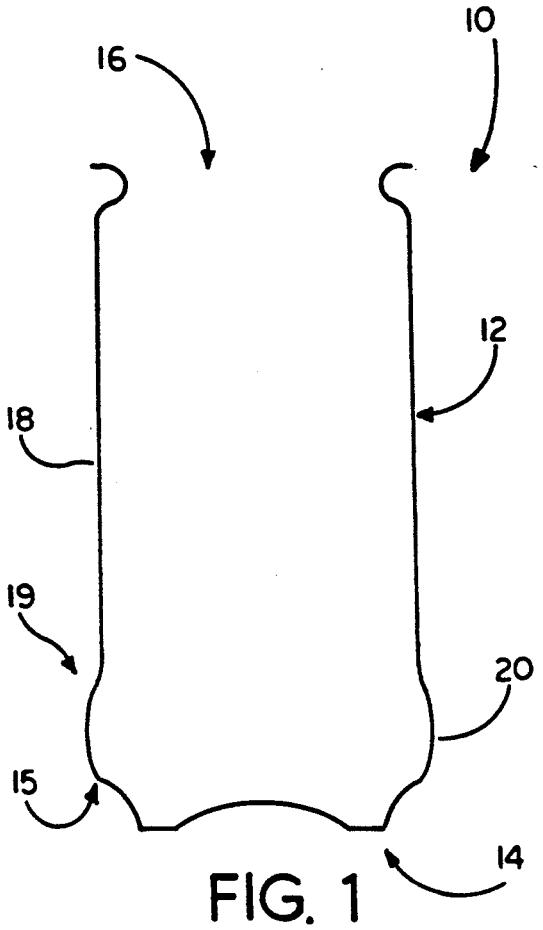
FIG. 1
FIG. 5
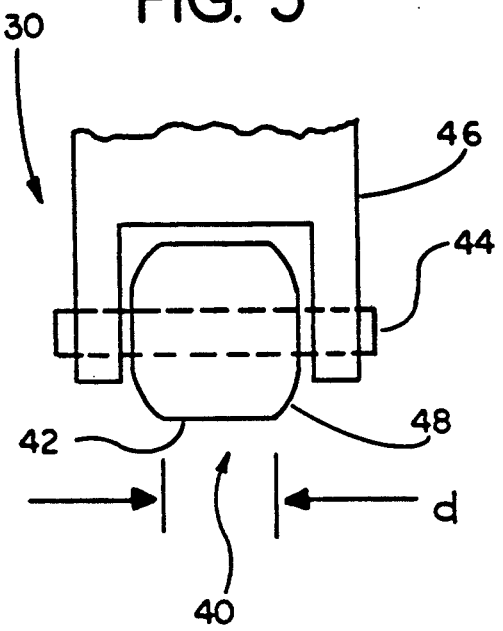
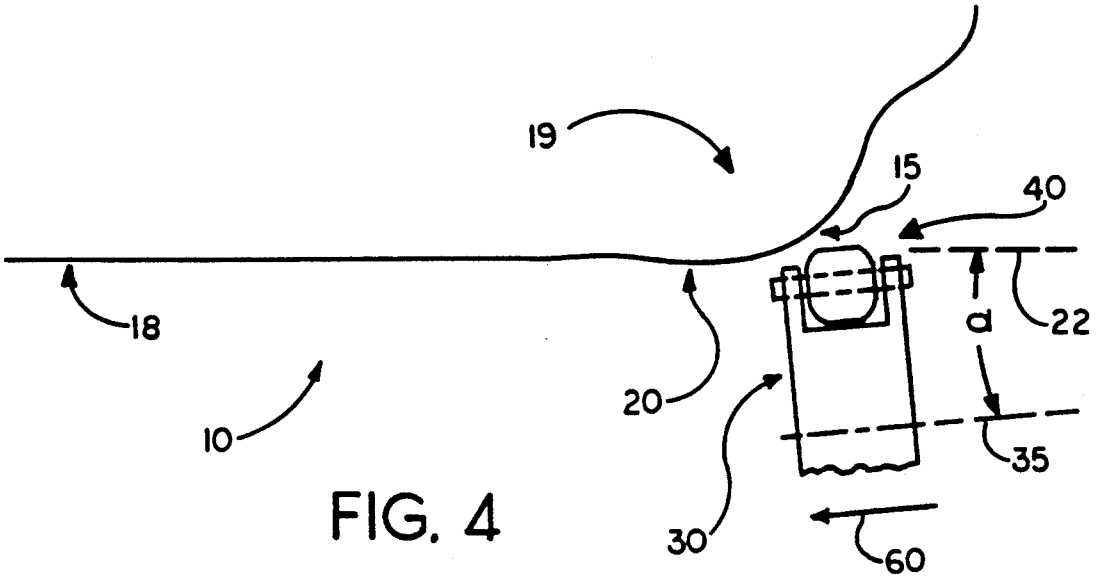
FIG. 4

18
19
19
BEFORE
20
22
X
15
Y
18
26
AFTER
24
X
15
22
Y

METHOD OF REFORMING A METAL CONTAINER TO INCREASE CONTAINER STRENGTH

TECHNICAL FIELD OF THE INVENTION

This invention relates to methods of reforming containers and, more particularly, relates to a method of reforming a metal container to reduce its stripper bulge and enhance the axial strength of the container.

BACKGROUND OF THE INVENTION

In the highly competitive container industry, a container must be made with the absolute minimum of material, which means that the finished container must have extremely thin walls. At the same time, however, a container must have sufficient strength to avoid collapsing or losing its cylindricity and, hence, its structural integrity.

Metal containers are generally made as two-piece containers. In the two-piece form, the container body and one end are formed integrally and a separate end is later attached to the open end of the container. Two-piece containers may be made in several ways. One of these ways includes the wall-iron process wherein a shell cup is produced from sheet metal by conventional drawing techniques and is then redrawn to a cup of longer length and smaller diameter. The redrawn cup is then wall-ironed to produce the required body length and wall thickness. Containers manufactured by this process are commonly referred to as drawn-and-ironed ("D&I") containers.

A second way of forming a container body with an integral end is the impact-and-ironed forming process wherein a short cup of proper diameter but with a heavy wall thickness is formed by the impact-extrusion-forming process. The impact-extruded short cup is then pushed through ironing dies to reduce the wall thickness and increase the length of the cup to the required length for trimming and flanging operations.

Where a container body is formed by the drawn-and-ironed process, or by the impact-and-ironed forming process, a cup, formed as described above, is reformed to a container body of longer length by an ironing procedure whereby the cup is moved through a series of ironing rings so as to reform the cup into intimate contact with the punch and to iron the cup sidewall to the proper container body length. Conventional methods often incorporate redrawing and ironing into one machine.

After the oversized cup on the ironing punch has been ironed by passing it through the series of ironing rings, the container body so formed must be removed or "stripped" from the ironing punch. To remove the container from the ironing punch, the stripping operation usually employs compressed air directed through one or more passageways which are integrally designed into the machinery, as the primary means of stripping the container bodies from the punch. Mechanical strippers are sometimes employed to ensure that the container bodies are actually removed from the punch.

In the stripping of the container from the ironing punch, a circumferential outward bulge is commonly formed adjacent the lower portion or closed end of the container. This bulge, commonly referred to as the "stripper bulge," has been found to decrease the axial strength of the container, thereby increasing its propensity to collapse or lose its cylindrical integrity. Stripper bulges are found on substantially all containers manufactured by the methods including the wall-ironing process, regardless of the manufacturer. Contour tracings of numerous containers from several manufacturers reveal that the stripper bulge is from 0.004 to 0.010 inches greater in diameter than the straight cylindrical sidewall of the containers.

The majority of conventionally formed containers are sold to industry in an "as made" state. Heretofore, no attempts have been made to improve the integrity of ironed containers by reworking the lower portion of the container to reduce or eliminate the stripper bulge.

SUMMARY OF THE INVENTION

This invention presents a method of improving the strength of metal containers with a stripper bulge by reworking the stripper bulge portion of the lower sidewall portion adjacent to the closed end of the container. It is believed that reduction of the stripper bulge can lead to improvement of the strength and reliability of well-made ironed containers, and tests have indicated that the axial strength of well-made containers can be improved through a reduction of the stripper bulge with this invention.

More particularly, this invention presents a method of reforming an ironed metal container by reworking the stripper bulge adjacent the bottom or closed end of the container to remove a substantial portion of the bulge. The reworking of the stripper bulge is carried out by providing relative rotational movement of the container and rolling means and then moving the rolling means relatively axially along a linear path disposed at an acute angle with respect to a central axis of the container so as to cause the rolling means to bear against the stripper bulge adjacent to the closed end of the container and to deform the stripper bulge generally radially inwardly toward the central axis of the container. The preferred rolling means is defined by a bearing element having a narrow cylindrical force-applying surface.

Further features of the invention will be apparent from the following drawings and disclosure of a preferred embodiment of its method of operation.

BRIEF DESCRIPTION OF THE DRAWINGS

FIG. 1 is a longitudinal sectional view of a container having an integral stripper bulge formed, for example, by conventional D&I forming methods;

FIG. 4 is a diagrammatic view illustrating the linear path, with respect to a container, of a preferred rolling means employed in the reforming operations of this invention; and FIG. 5 is a plan view of a preferred rolling means provided by this invention.

BEST MODE FOR CARRYING OUT THE INVENTION

Figures 2, 3:
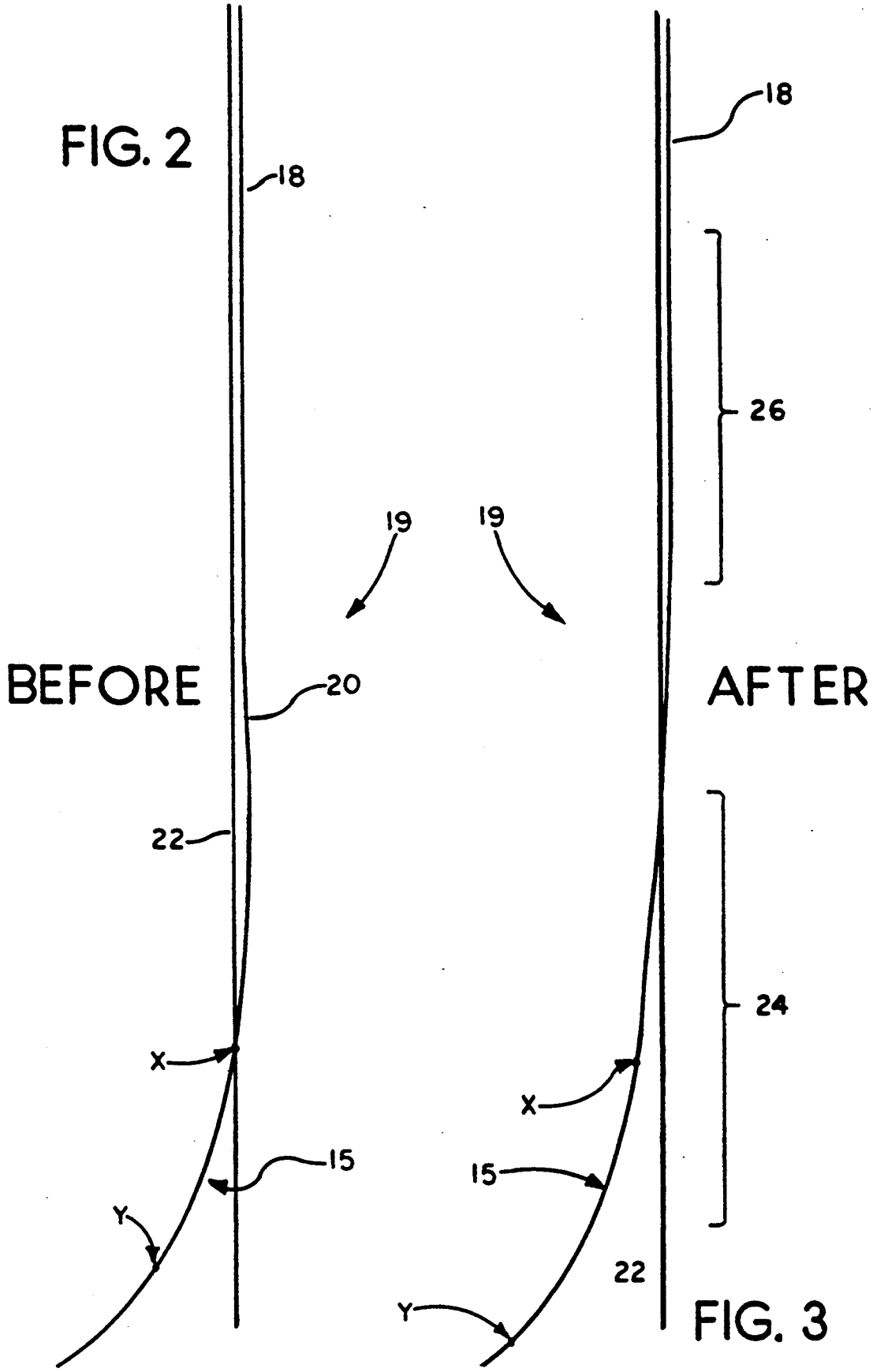
FIG. 2 is an enlarged isolated cross-section of the lower sidewall portion of the container of FIG. more clearly illustrating the stripper bulge formed therein.
FIG. 3 is an enlarged isolated profile of the lower sidewall portion of a container reformed by the method of this invention illustrating the resulting configuration of the lower sidewall portion of the container.

As shown in the enclosed drawings, wherein like numerals refer to like elements, this invention presents a method of reforming ironed metal containers 10 by reworking their lower sidewall portions 19 to thereby improve their axial strength and reliability. Referring now to FIG. 1, a metal container 10, as, for example, formed by the D&I process, is shown and comprises a body 12 having a closed end 14, an open end 16, a sidewall 18, lower sidewall portion 19, a lower curved portion 15 integrally connecting the closed end 14 to lower sidewall portion 19, and a stripper bulge 20 formed within the lower sidewall portion 19.

As described above, stripper bulge 20 is formed as a result of the stripping or removing of container 10 from its forming punch (not shown). Stripper bulge 20, as shown in FIGS. 1 and 2, extends circumferentially outwardly about the container body 12 adjacent to closed end 14. It has been found that two-piece D&I containers undergoing tests for axial load resistance often collapse upon the flexing of the stripper bulge 20, which causes container 10 to lose its cylindricity and, hence, its structural integrity. This invention presents a method of reworking the stripper bulge by reforming the lower portion 19 of sidewall 18 to enhance the axial strength of the resultant container.

Referring now to FIG. 2, an enlarged, isolated cross-section of lower portion 19 of sidewall 18 of container 10 is shown illustrating the conventional configuration of stripper bulge 20 and lower curved portion 15 of a container formed by typical D&I forming methods. FIG. 2 illustrates how stripper bulge 20 extends circumferentially outwardly from sidewall orientation cylinder 22, which is provided for reference to illustrate the configuration changes brought about by this invention. As typically formed, sidewall 18 and stripper bulge 20 cross sidewall orientation cylinder 22, that is, extend radially inwardly toward the central axis of container 10, at reference point "x".

For comparison, FIG. 3 illustrates a resulting configuration of lower portion 19 of sidewall 18 and lower curved portion 15 produced by the reforming operation of this invention. Stripper bulge 20 has been reduced significantly by the deflection of its lower portion generally radially inwardly toward a central axis of the container, thereby leaving a slight residual bulge 26 at a position generally higher along sidewall 18 than the position of stripper bulge 20 as originally formed in FIG. 2. Testing by the applicant has determined that it is preferable to leave a residual bulging portion defined by bulge 26 rather than removing the stripper bulge entirely because removing bulge 20 entirely disturbs the thin wall portion of the containers too substantially, thereby reducing the axial strength of container 10. As a further result, a greater portion of lower sidewall portion 19 has been deflected inwardly of the sidewall orientation cylinder 22 to define a reformed zone 24. (As shown in FIG. 3, reference point "x" now lies inwardly of sidewall orientation cylinder 22.) The reforming operation of this invention also changes the radius of lower curved portion 25 from approximately 0.200 inches at reference point "y" in FIG. 2 to approximately 0.150 inches as shown in FIG. 3, thus resulting in a reduction of the radius of lower curved portion 15 by approximately 0.050 inches. It is believed that the reformed metal moves toward the bottom end 14 of the container during the reforming operation, thereby reducing the radius of curved portion 15.

The preferred method of operation of this invention will now be described in relation to FIGS. 4 and 5. The reforming method provided by this invention generally includes reworking the lower portion 19 of sidewall 18 to remove a substantial portion of stripper bulge 20 by deforming a localized portion of lower portion 19 generally radially inwardly by use of rolling means 30 provided with a bearing element 40. The container 10 and rolling means 30 are provided with relative rotational movement and rolling means 30 is then moved generally axially with respect to container 10 toward the closed end 14 thereof, as shown by reference arrow 60, so that bearing element 40 initially engage stripper bulge 20 of the lower portion 19 at a selected point along sidewall 18 and is then moved in continuous engagement with stripper bulge 20 along a linear path 35 at an acute angle "a" with respect to the sidewall orientation cylinder 22. The acute angle "a" is preferably approximately one to two degrees. The selected point along sidewall 18 where bearing element 40 initially engages stripper bulge 20 is preferably closely adjacent to the closed end 14 of the container. Bearing element 40 is maintained in continuous engagement with the stripper bulge 20 as rolling means 30 is moved along linear path 35 and deflects the container sidewall radially inwardly. As a result of the preferred reforming method described above, the resulting configuration of the lower portion 19 of container 10 includes sidewall 18 having residual bulge 26 in a position generally higher along sidewall 18 than as originally formed and whose final diameter is less than that of bulge 20 as originally formed. The resulting configuration further includes reformed portion 24 deformed inwardly of sidewall orientation cylinder 22, all as shown in FIG. 3.

The preferred angle "a" of travel of rolling means 30 of approximately one to two degrees assures that only the desired lower portion 19 of sidewall 18 is worked upon by rolling means 30 as it is desirable to rework only that portion during the reforming operations. The depth or amount of reforming is determined by finding the maximum diameter of stripper bulge 20 before the reforming operation, then by moving rolling means 30 axially along the container to clear stripper bulge 20, then advancing rolling means 30 toward a central axis of the container by the prescribed amount of approximately 0.010 to 0.030 inches, and then by moving rolling means 30 axially along linear path 35. Testing further indicates that the preferred manner of securing container 10 for rotational movement includes a plug (not shown) which fits into the open end 16 of container 10, while closed end 14 is supported at its outer bottom surface by a matching plug (also not shown), upon a suitable lathe-type apparatus.

Referring now to FIG. 5, rolling means 30 is shown having a bearing element 40 with a generally cylindrical force-applying surface 42 journaled for rotation about journaled shaft 44, which is supported in a yoke 46. Force-applying surface 42 preferably has a width "d" which is preferably narrow, for example a "d" of approximately 0.030 inches. While the bearing element 40 shown in FIG. 5 is configured to have an octagonal cross-section with angled side surfaces 48, the particular shape of the bearing element is not essential as long as the actual force-applying surface that engages the container has a narrow width. For example, a bearing element having a can-engaging periphery with a circular or narrow rectangular cross-section may be employed with this invention. Testing by the applicant has indicated that a bearing element having a wide force-applying surface tends to make shallow dips in the container surface in the reworked area, thereby weakening the axial load resistance of the container. Moreover, it is preferable that bearing element 40, regardless of its cross-sectional configuration, have rounded edges adjacent to force-applying surface 42 to prevent the cutting of the container as the rolling means 30 traverses the stripper bulge 20.

The reforming method of this invention may be further understood by reference to the following example.

Example One

In testing, the open ends 16 of a series of containers 10 were disposed facing the head stock of a lathe and secured by a plug and the closed ends 14 of containers 10 were supported on a freely rotating plug supported by the tailstock of the lathe. Container test groups were taken from three container body makers ("B/M"), each operating under identical conditions. Containers from body makers 1 and 2 were made from the same single coil of metal. Unreformed containers and containers reformed by this invention were tested for axial strength. Containers from body maker 3 were taken from a different coil of metal. The following results were obtained:

TABLE One

| | Axial Strength Data | | |
|---|---|---|---|
| | B/M #1 | B/M #2 | B/M #3 |
| Unreformed containers | 348 ± 17 | 319 ± 32 | 263 ± 26 |
| Reformed .010" at 1° | 349 ± 6 | 333 ± 27 | 265 ± 30 |
| Reformed .020" at 1° | 356 ± 3 | 350 ± 19 | 282 ± 26 |
| Reformed .030" at 1° | 357 ± 3 | 350 ± 29 | |

The above data illustrates that the benefit derived from the reforming process of this invention is not uniform or applicable to all manufactured containers. The reforming method of this invention has been found to make a container of normal strength stronger (see the results under B/M #1 and B/M #2), but the reforming method will do little to improve the strength of a fundamentally poor-quality container as originally made (see the results under B/M #3). The specific basis for this phenomenon is not yet fully understood.

Although the method provided by the present invention has been described with the preferred embodiment, those skilled in the art will understand that modifications and variations may be made without departing from the scope of this invention as set forth in the following claims. Such modifications and variations are considered to be within the purview and scope of the appended claims.

I claim:

1. A method of reforming a metal container having a laterally bulging area disposed circumferentially about a lower portion of the container, said method comprising reworking the bulging area to remove a substantial portion thereof by deforming said bulging area generally radially inwardly toward a central axis of said container.

2. The method of reforming a metal container as in claim 1 wherein the deforming of the bulging area is carried out by narrow rolling means.

3. The method of reforming a metal container as in claim 2 wherein said narrow rolling means and container are provided with relative rotational movement, and wherein said narrow rolling means is moved relatively axially along a linear path so as to bear against and deform the bulging area of said container radially inwardly.

4. The method of reforming a metal container as in claim 3 wherein said rolling means is moved along a linear path disposed at an acute angle with respect to a central axis of said container.

5. The method of reforming a metal container as in claim 4 wherein said acute angle is approximately one to two degrees.

6. The method of reforming a container as in claim 7 wherein said container is formed from aluminum.

7. A method of reforming a container comprising the steps of:

providing a container having a generally cylindrical sidewall, a closed end, an open end, and a curved portion with a predetermined radius intergrally connecting the sidewall and the closed end of the container, said sidewall having a circumferential bulge disposed adjacent to the curved portion and the closed end of the container, said circumferential bulge extending outwardly past the cylindrical sidewall of said container;

providing a rolling means having a narrow force-applying surface;

securing the container at its ends;

providing the container and the rolling means with relative rotational movement;

providing the container and the narrow rolling means with relative axial movement so as to cause the narrow force-applying surface of said rolling means to engage and bear against the bulge of said container adjacent to the closed end thereof and to move along a linear path lying at an acute angle with respect to a central longitudinal axis of said container so as to deflect the container material radially inwardly along said bulge.

8. The method of reforming a container as in claim 7 wherein said reforming operation decreases the radius of the curved portion of said container.

9. The method of reforming a container as in claim 8 wherein the radius of the curved portion of the container is reduced in magnitude by the reforming operation by an amount of approximately 0.050 inches.

10. The method of reforming a container as in claim 7 wherein said acute angle is a diverging angle of approximately one to two degrees.

11. The method of reforming a container as in claim 7 wherein said narrow rolling means is provided with a generally cylindrical bearing surface having a width of about 0.020 to about 0.030 inches.

12. A method of reforming a beverage container fabricated of ductile metal, comprising the steps of:

providing a container having a generally cylindrical sidewall, an integral closed end, an open end and a curved portion integrally interposed between said sidewall and said closed end, said sidewall having a generally straight upper portion and a lower portion with an outwardly extending stripper bulge adjacent to the closed end of the container, said straight upper portion of the sidewall defining a sidewall orientation cylinder, said lower portion of the sidewall and said stripper bulge being disposed generally outwardly of said sidewall orientation cylinder;

providing a bearing element having a narrow generally cylindrical force-applying surface journalled for rotation;

providing the container with rotational movement; and moving the bearing element generally axially with respect to the container toward the closed end thereof so that the force-applying surface of said bearing element engages the stripper bulge of the sidewall, and moving the bearing element along a liner path disposed at an acute angel with respect to the sidewall orientation cylinder, while maintaining the force-applying surface of said bearing element in engagement with the stripper bulge to deflect the stripper bulge generally radially inwardly, whereby the resulting container configuration includes a generally cylindrical sidewall with a reduced stripper bulge and a lower portion disposed inwardly of the sidewall orientation cylinder.

13. The reforming method as in claim 12 wherein said stripper bulge is substantially displaced by said reforming operation.

14. The reforming method as in claim 12 wherein said acute angle is approximately one to two degrees.

15. The reforming method as in claim 12 wherein the force-applying surface of said bearing element has a width of approximately 0.030 inches.

16. The reforming method as in claim 12 wherein said curved portion has a radius of predetermined initial magnitude, and wherein said reforming operation generally reduces said radius in magnitude.

17. The reforming method as in claim 16 wherein said reforming operation reduces said radius from approximately 0.200 inches to approximately 0.150 inches.

18. The reforming method as in claim 12 wherein a residual bulge remains disposed circumferentially about the sidewall of the container at a position generally higher along the sidewall than as the stripper bulge was originally formed.

19. A method of enhancing the reliability of closed end metal containers which have a substantially cylindrical sidewall having a portion bulging outwardly from the central axis of the container past the generally cylindrical sidewall, said method comprising the steps of:

supporting the metal container for rotation about the central axis of the generally cylindrical sidewall and rotating the metal container about the central axis of metal container sidewall; and applying force to a localized portion of the bulging portion of the substantially cylindrical sidewall of the container to deform said localized portion toward the central axis of said container.

20. The method of claim 19 wherein said force is applied to said localized portion with a rolling means.

21. The method of claim 20 wherein said rolling means is moved along the metal container axis to apply localized force to the bulging portion adjacent the closed end of the metal container.

22. The method of claim 21 wherein said rolling means is moved along a divergent path lying at an angle of about 1 degree to 2 degrees with respect to the metal container axis.

23. The method of claim 22 wherein said rolling means applies localized force from a central portion of the bulging portion of the sidewall to the closed end of the container.

24. The method of claim 23 wherein said rolling means applies localized force that reduces the diameter of the bulging portion.

25. The method of claim 20 wherein said rolling means deflects said localized portion inwardly a distance of about 0.010 to about 0.030 inches toward the central axis of said container.

* * * * *